United States Patent [19]

Lee et al.

[11] 4,120,310

[45] Oct. 17, 1978

[54] FILTER FOR CIGARETTES, CIGARS AND THE LIKE

[76] Inventors: Choon Bae Lee, 273-22; Byung Chul Lim, 35-13, both of Roryang jin-2-dong, Kwanak-koo, Seoul, Korea

[21] Appl. No.: 749,614

[22] Filed: Dec. 10, 1976

[51] Int. Cl.[2] ..... A24D 7/04

[52] U.S. Cl. ..... 131/261 B; 131/212 A

[58] Field of Search ..... 131/261 R, 261 B, 10.5, 131/10.3, 212 A, 212 R

[56] References Cited

U.S. PATENT DOCUMENTS

| | | | |
|---|---|---|---|
| 3,304,943 | 2/1967 | Gunther | 131/10.5 |
| 3,502,087 | 3/1970 | Romano | 131/261 R |
| 3,651,819 | 3/1972 | Beard | 131/261 B |
| 3,757,802 | 9/1973 | Strevle et al. | 11/10.5 X |
| 3,877,470 | 4/1975 | Jewett et al. | 131/261 B |

*Primary Examiner*—Stephen C. Pellegrino

*Attorney, Agent, or Firm*—Wenderoth, Lind & Ponack

[57] ABSTRACT

A cup-like filter for smoking articles having a deflected passage of smoke through a smoke pooling chamber, perforations and a side corridor space for removal of noxious constituents of smoke-entrained tars and nicotine, and an "H" shaped filter having a deflected passage of smoke through a front smoke chamber, perforations, a side chamber, perforations again and finally a rear smoke chamber, being double-faced so as to be readily rolled into the processes of cigarette-making machine regardless of its face.

4 Claims, 4 Drawing Figures

FILTER FOR CIGARETTES, CIGARS AND THE LIKE

BACKGROUND OF THE INVENTION

The present invention relates to a filter construction for cigarettes, cigars, cigarette holders and tobacco pipes for the purpose of removing noxious and harmful constituents entrained in the smoke of tobacco such as nicotine, tar and the like.

FIELD OF THE INVENTION

Prior Arts

Most of cigarette filters currently employed worldwide are produced from materials such as bleached cotton, thermoplastic cell fibers and the like, and some in combination with activated charcoal. In the case of cigarette holders and tobacco pipes, filter cartridges are employed, which usually comprise a hollow cylinder filled with materials such as activated charcoal or similar minerals.

As described in U.S. Pat. No. 3,304,943 by R. F. Gunther and No. 3,757,802 by Josef Streule and Blasius Brot, some of the prior art filters comprise a plurality of telescopic or elongated tubular spaced members interlocked with each other which, when assembled, define plural reversing passages of smoke extending longitudinally and axially of the filter structure the smoke is deflected through several "U" turns, so that the smoke will be cooled and at the same time subjected to a distillation process resulting in deposits on the filter surface touched by the smoke and resulting in filtration.

However, both the above teachings must have respectively at least three of telescopic tubular members in order to form elongated reversing passages therebetween and the purpose of the filter structure can not possibly be accomplished by only two of those tubular members, and this would surely bring about a problem in manufacturing the intricate webby structure of many component elements economically so that they could be commercially employed as filters for cigarettes or cigars, not speaking of the difficulty in incorporating them with the same during the manufacturing process thereof.

Moreover, referring to the lower portion of FIG. 1 of the drawings of the prior art by Josef Streule et al, while a considerable amount of greasy nicotine and tar is trapped by the smoke passing slots disposed along the peripheral portion of the tubular body 6, the trailing flows of smoke passing therethrough are naturally contaminated with the sticky deposits of nicotine and tar trapped from the forerunning flows of smoke, and the accumulation of the deposits from the successive flow of smoke in its due course clogs the slots even when the filter is held horizontally.

This is all due to the location of the smoke passing slots in the lowermost portion of the downstream of the filter structure. The smoke is sort of being cornered into the innermost corner of a narrow cave where the "U" turns of the converging flow of smoke take place and there is little space for the deposits of nicotine and tar to spread around, to be out of the way of the trailing flow of smoke. A better effect and result would have been attained if the location of the smoke passing slots were spaced upwardly from and elevated well above the lower end of the downstream of the tubular body 6 of the filter structure. What's more, there would be no risks of being clogged by possible accumulation of the deposits of tobacco nicotine and tar.

However, the two patents discussed above or similar types of filter structure had not been commercially adopted, probably because they are too expensive to produce and are not adaptable for production on high speed cigarette-rolling machines.

SUMMARY OF THE INVENTION

It is contemplated in the embodiments of the present invention that a filter, comprising only two tubular portions in a simple and single structure, will define a deflecting passage for smoke, whereby a jet flow of smoke will be forcibly projected onto the filter surface and condensed into deposits on the surface thereof to trap the noxious and harmful constituents entrained in the smoke.

Accordingly, an object of the present invention is to provide a filter for smoking articles, which efficiently removes noxious and harmful constituents such as nicotine, tobacco tar and the like, entrained in smoke.

Another object of the invention is to provide a filter which provides means for the retention of smoke-entrained tar and nicotine due to the construction thereof.

A still another object of the invention is to provide a filter which can be adaptably employed in cigarettes and cigars, singly or in combination with the conventional cell fiber filter.

A further object of the invention is to provide filter cartridges for cigarette holders and tobacco pipes.

A still further object of the invention is to provide a filter of simple and single construction which may be produced in large quantity inexpensively and may be readily rolled into the conventional cigarette rolling machine in the cigarette-making process.

Further objects and additional advantages will appear from the following description, accompanying drawings and the appended claims.

BRIEF DESCRIPTION OF THE DRAWINGS

Referring to the drawings, showing specifically filters employed in cigarettes, as preferred embodiments of the present invention, wherein.

DETAILED DESCRIPTION OF PREFERRED EMBODIMENTS

Figure 1:
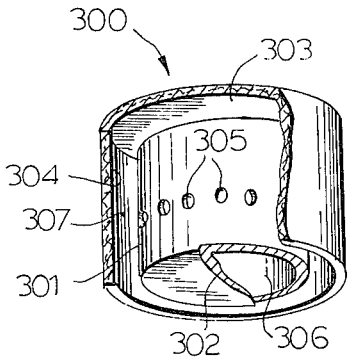
FIG. 1 is a perspective view of a filter constructed in accordance with one embodiment of the invention, with a portion cut away for the sake of clarity.
Figure 2:
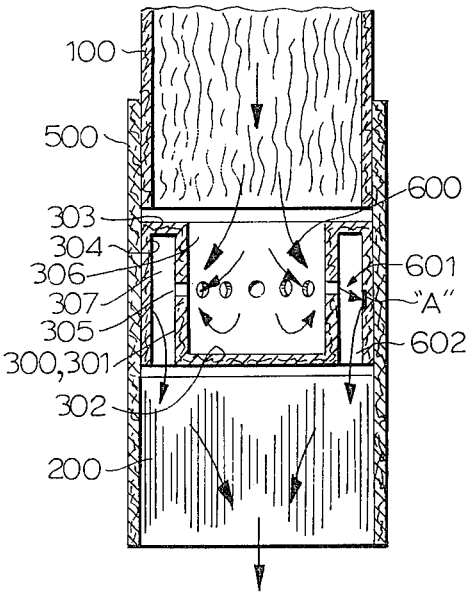
FIG. 2 is a fragmentary longitudinal sectional view of a cigarette in which the flter structure shown in FIG. 1 is incorporated therein as a median filter between the tobacco filler and conventional fiber filter.
Figure 3:
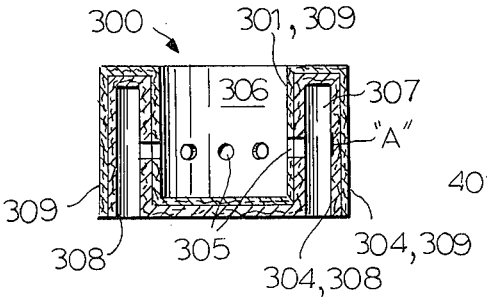
FIG. 3 is an elevational sectional view of a modified form of the filter structure shown in FIGS. 1 and 2.

It will be understood that in the drawings, the filter structures in accordance with the invention are generally illustrated as a median filters for cigarettes only and that it will be apparent to those skilled in the art that these filters are readily be employed as a filter for cigars and as a filter cartridge for cigarette holders and tobacco pipes as well. FIGS. 1, 2 and 3 of the drawings pertain to the first embodiment of the present invention, and FIG. 4 to the second embodiment thereof.

In the first embodiment of the invention, referring first to FIG. 2 of the drawings, a filter structure in accordance with the present invention is incorporated as a median filter 300 between a cigarette body 100 and a conventional fiber filter 200 of thermoplastic cell fiber and is wrapped in assembled relation by a tipping band 500 together with the cigarette body and the conventional fiber filter.

The median filter or the cup-like filter 300 of the invention can be made of paper or any other suitable material, preferably of the material which is highly efficient in absorbing, upon being in contact with, the noxious and harmful constituents entrained in the cigarette or tobacco smoke such as tar, nicotine and the like, in the form of vapor or condensed water.

In the cup-like filter 300 having generally a cup-shaped configuration shown in FIGS. 1 and 2, a cup-like inner tubular portion 301 is provided with a bottom portion 302 closing the bottom end thus, thereby substantially defining a smoke pooling chamber 306.

A flange portion 303 formed integrally with the top peripheral rim of the cup-like inner tubular portion 301 extends radially outwardly.

Also formed integrally on the outer periphery of the flange portion 303 is an outer tubular portion 304 extending downwardly therefrom the axial length of the inner tubular portion 301 in concentric, parallel and spaced relation thereto, thus defining an annular corridor space 307 between to outer tubular portion 304 and the inner tubular portion 301.

A plurality of perforations 305 are provided along the mid portion of the peripheral wall of the inner tubular portion 301, thereby communicating the smoke pooling chamber 306 enclosed by the inner tubular portion 301 and the annular corridor space 307 between the inner tubular portion 301 and the outer tubular portion 304, thus substantially forming a through passage for the smoke.

The smoke pooling chamber 306 enclosed by the inner tubular portion 301 comprises in the upstream end thereof a smoke inlet for the smoke entering thereinto from the abutting tobacco filler of the cigarette body 100, and the annular corridor space 307 between the inner tubular portion 301 and the outer tubular portion 304 comprises in the downstream end thereof a smoke outlet for the smoke passing therethrough and into the abutting conventional fiber filter 200.

An attack surface "A" or a hitting board, against which a hot jet flow of smoke 601 gushing out of the perforations 305 into the annular crridor space 307 may be projected is provided on the inner peripheral wall of the outer tubular portion 304, and is in proximity with respect to the perforations 305 and is spaced upwardly from and elevated well above the downstream of the outer tubular portion 304 a spacious absorptive surface is thus provided for the condensed water of smoke containg tars and nicotine to be readily absorbed and spread radially around.

While the number of the perforations 305 can either be increased or decreased and the diameter thereof can either be widened or narrowed for an optimum result, the location of the perforation 305 must also be spaced upwardly from and elevated well above the lower end of the bottom portion 302 of the cup-like inner tubular portion 301 or be on a level spaced upwardly from and elevated well above the skirt end of the outer tubular portion 304. Because of spacious landing surface required for the expected deposits of the smoke-entrained tars and nicotine trapped thereon, the absorptive surface is spread radially to be out of the way so that as much as possible of the deposits will not contact be and carried along by the railing jet flow of smoke 601.

In comparison with the perforations 305 shown in FIG. 2, if the perforations 305 are provided, for example, on the lower end of the peripheral wall of the inner tubular portion 301, then the jet flow of smoke 601 gushing out of the perforations will, missing the laterally facing attack surface "A" on the inner peripheral wall of the outer tubular portion 304, directly hit the upstream portion of the conventional fiber filter 200 instead, thereby accumulating ever increasing deposits of nicotine and tars and further causing the fiber filter 200 to become badly saturated with the harmful smoke constituents.

While the generally cup-shaped filter 300 can be made purely out of paper, it could also be formed out of thermoplastic sheet masterial by means of vacuum forming. However, since plastic material has the unique characteristic of being water-proof, it is incapable of absorbing the liquid constituents of smoke-entrained tars and nicotine.

In the embodiment of the present invention in FIG. 3, a modified form of the cup-like filter 300 is made out of a sheet material consisting of a paper layer 308 and a plastic layer 309 by means of thermoplastic hot press forming.

In the modified filter 300, the paper layer 308 is capable of absorbing the smoke-entrained constituents while the plastic layer 309 a facilitates formation of the filter structure as a whole and at the same time constitutes a back-bone thereof so as to retain the original form.

Suitable sheet material for the hot press forming described above can be made in such a manner that a sheet of paper can either be provided on one surface thereof with a plastic coating or the paper can be laminated with a sheet of plastics to comprise one paper layer 308 and the other a plastic layer 309.

It should be appreciated that the two-layer sheet material is arranged in the process of filter-forming to have the paper layer 308 as the underlayer thereby forming a paper lining over the inner peripheral wall of the outer tubular portion 304 of the cup-like filter 300, whereby the paper layer 308 or paper liner substantially forms an absorptive surface or the attack surface "A" for smoke-entrained tars and nicotine to land or settle thereon and then spread radially around.

Figure 4:
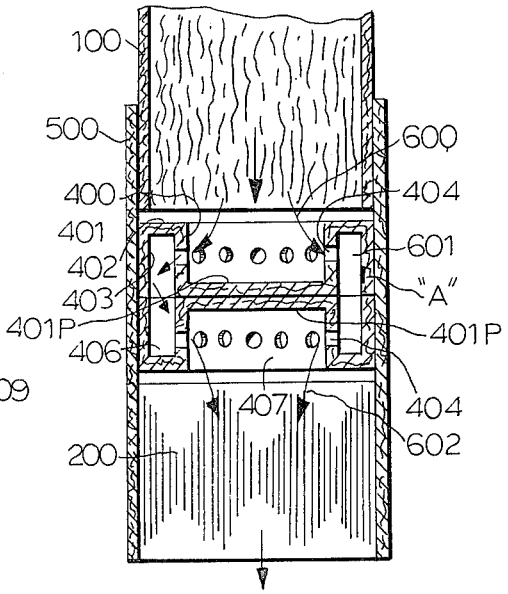
FIG. 4 is a fragmentary longitudinal sectional view of a cigarette in which a filter structure being incorporated therein as a median filter between the tobacco filler and conventional fiber filter, the filter structure being a modified form constructed in accordance with another embodiment of the present invention.

Now, in the second embodiment, referring specifically to FIG. 4 of the drawings, an "H"-shaped filter structure 400 also in accordance with the present invention is incorporated as a median filter between the cigarette body 100 and the conventional fiber filter 200 and is wrapped during assembly by a tipping band 500 together with the cigarette body and the fiber filter in exactly the same manner as in the foregoing first embodiment shown in FIG. 2.

The H-shaped filter 400 is actually a duplicate of the cup-like filter 300 which was discussed in the first embodiment (as shown generally in FIGS. 1, 2 and 3), with their tails, the bottom portions (302) thereof, being, stuck together by any suitable means, such as glueing or thermoplastic heat-pressing, so as to be double-faced.

The H-shaped filter 400 comprises an inner tubular portion 401 having in the mid-portion thereof a partition 401p which substantially separates the hollow of the inner tubular portion 401 into a front smoke pooling chamber 405 in the upper hollow thereof and a rear smoke pooling chamber 407 in the lower hollow thereof thereby forming the general configurations of the inner tubular portion 401 and the filter structure 400, as a whole in the shape of the letter "H" (FIG. 4).

Integrally extending radially outwardly from the peripheral rims of the upper and lower inner tubular portions 401 respectively are flange portions 402 which in turn integrally extend downwardly and upwardly to jointly form an outer tubular portion 403 in a concentric, parallel and spaced relation thereto the "H" shape inner tubular portion 401, thereby substantially defining therein the hollow space an annular side chamber 406 between the inner 401 and outer tubular portion 403.

Along the mid portion of the peripheral walls of the upper and lower portions of the "H"-shaped inner tubular portion 401, a plurality of perforations 404 are communicate the front smoke pooling chamber 405, the annular side chamber 406 and the rear smoke pooling chamber 407, and further substantially constitute a through passage for the smoke, as is clearly shown in FIG. 4.

The front smoke pooling chamber 405 defined by therein the upper hollow of the "H"-shaped inner tubular portion 401 comprises in the upstream end thereof a smoke inlet for the smoke emerging thereinto from the abutting tobacco filler of the cigarette body 100, while the rear smoke pooling chamber 407 (herein instead of annular side chamber 406, Unlike of the first embodiment wherein the annular corridor space 307, the corresponding part thereof, takes the part) defined by the lower hollow of the inner tubular portion 401 comprises in the downstream end thereof a smoke outlet for the smoke passing out therethrough into the abutting conventional fiber filter 200.

An attack surface "A" or a hitting board, against which a hot jet flow of smoke 601 gushing out of the perforations 404 on may be projected, is provided on the inner peripheral wall of the outer tubular portion 403, as is in proximity with respect to the perforations 404 so as to have a spacious absorptive surface for the condensed water of smoke containg tars and nicotine to be readily absorbed and spread radially around.

Finally, of the numerals shown generally in FIGS. 2 and 4, the numeral 600 indicates a converging flow of smoke, 601 jet flow of smoke and 602 diverging flow of smoke. When with the cigarette body 100 is lit and smoked by a smoker, the smoke emerging from the abutting tobacco filler of the cigarette body 100, is guided by the blocking annular flange portion 303 and first enters into the smoke inlet defined by the upstream end of the smoke pooling chamber 306 (which is defined by the cup-like inner tubular portion 301) and then enters into the spacious hollow of the smoke pooling chamber 306, only to be drawn into a vortex.

While in the vortical condition in the smoke pooling chamber 306, the smoke, one portion after another, is forcibly drawn in a form of converging flow 600 into the plurality of perforations 305 provided at the mid portion of the peripheral wall of the inner tubular portion 301.

After passing outward through the tiny perforations 305, the smoke (now full of hot vapors) contains in quantity noxious and harmful constituents of tars and nicotine and with its velocity highly accelerated, is forcibly projected in a form of hot jet flow 601 against the comparatively cooler and spacious attack surface "A" provided on the mid portion of the inner peripheral wall of the outer tubular portion 304. At this point, the smoke in the form of hot jet flow full of hot vapors is cooled and condensed into droplets upon contact with the cooler attack surface "A" and is further readily absorbed thereby and spread radially around the spacious attack surface. The droplet are then out the way of and are prevented from carried along by the trailing jet flow 601 of the smoke.

It should now be appreciated that the filter construction 300 is made out of highly absorptive paper material and the attack surface, being a portion thereof, is naturally highly absorptive and since a number of attacks occur on thereon the attack surface "A" by successive jet flows 601 of smoke, the trapped droplets of tars and nicotine should be readily cleared out of the way, otherwise the droplets trapped from the forerunning jet flow of smoke would be taken to the mouthpiece of the cigarette and then into the mouth of a smoker by the trailing jet flow 601 of smoke. Accordingly a spacious surface for the droplets of the smoke-entrained constituents is required which will readily absorbed and spread radially the droplets as quickly as possible so that the droplets are out of the way before the trailing jet flow 601 of smoke arrives. As clearly shown in FIG. 2 of the drawings, the outer tubular portion 304 of the cup-like filter 300 is arranged to form an exterior portion of the filter 300 in close proximity to the atmosphere and accordingly, thus is the coolest portion of it all, and so is the attack surface "A" which is provided thereon and on which the smoke-entrained droplets of tars and nicotine in the jet flow 601 of smoke are to land to be cooled, absorbed and to spread all around.

Referring to FIG. 2 for further description, after the remainder of the jet flow 601 of the smoke hitting the attack surface "A" and being dispersed is properly cooled and purified of the noxious and harmful constituents of smoke-entrained, the smoke moves onward in a *a* form of diverging flow 602, passing through the smoke outlet in the downstream end of the annular corridor space 307 between the inner tubular portion 301 and outer tubular portion 304, and finally into the abutting conventional fiber filter 200, whereby whatever residue of the harmful substances are still contained in the smoke will be further stripped, fresh and healthful and tar- and nicotine-free smoking.

Referring to FIG. 3, the two-layered filter structure 300 is as effective as the filter 300 shown in FIG. 2 since it has the paper layer 308 or paper lining covering the inner peripheral wall of the outer tubular portion 304 on which the attack surface "A" for the jet flow 601 of smoke aforementioned is to be established.

The plastic layer 309 of the filter structure 300 not only facilitates easy forming thereof as a whole, but also forms a back-bone in retaining the original form thereof.

Referring finally to FIG. 4, during the operation of the "H"-shaped filter 400, also herein as a median filter, the smoke emerging from the abutting tobacco filler of the cigarette body 100, guided by the blocking upper annular flange portion 402, first enters into the smoke inlet in the upstream end of the front smoke pooling chamber 405 and then proceeds into the hollow thereof to be drawn into a vortex.

Then the smoke, one portion after another, is forcibly drawn in a converging flow 600 into the plurality of perforations 404 provided around the peripheral wall of the upper inner tubular portion 401.

The smoke full of hot vapors entraining noxious and harmful constituents passes outward through the perforations 404 and with its velocity highly accelerated, is forcibly projected in a form of a hot jet flow 601 against the cooler and spacious attack surface "A" provided on the inner peripheral wall of the outer tubular portion 403. At this point, the smoke in a form of hot jet flow 601 full of hot vapors is cooled and condenses into droplets upon the contact with the cooler attack surface, is readily absorbed thereby, and spreads radially around the spacious attack surface, so as to be out of the way and so as to prevent itself from being carried along by the trailing jet flow 601 of the smoke.

The remainder of the jet flow 601 of smoke hitting and dispersed against the attack surface, "A," properly cooled and purified of the harmful smoke-entrained constituents, moves onward as a of diverging flow 602 toward the downstream of the annular side chamber 406 and is drawn in a form of converging flow 600 again into the plurality of perforations 404, this time provided on the peripheral wall of the lower inner tubular portion 401.

Passing out through the perforations 404, the smoke purified in the foregoing process, enters into the rear smoke pooling chamber 407 and then moves onward as a diverging flow 602, passing through the smoke outlet in the downstream end of the rear chamber 407 and finally into the abutting conventional fiber filter 200. In the conventional filter, whatever the residue of the harmful substance remains is further stripped, before the smoke enters into the mouth of a smoker.

Being double-faced, the "H"-shaped filter 400 can be incorporated into cigarettes in either direction.

As generally shown throughout the figures, both the cup-like filter 300 and the "H" shaped filter 400 show remarkable advantages due to their cylindrical exterior construction since they could readily be rolled into any type of cigarette-making machine.

And as is apparent from the foregoing, the filters of the present invention can readily be employed as filters for cigarettes and cigars singly, or in combination with the conventional fiber filter, or as disposable filter cartridges for cigarette holders and tobacco pipes.

While the invention has been illustrated and described herein in its preferred embodiments, it is to be understood that various changes and modifications may be made without departing from the spirit and scope of this invention as defined in the appended claims.

We claim:

1. A smoking filter for use in cigarettes, cigars, cigarette holders and tobacco pipes, comprising:

a first cylindrical tube having a plurality of openings around the circumference thereof, said first tube being open at the top thereof;

a bottom covering across the bottom of said first cylindrical tube;

a second cylindrical tube surrounding and spaced from said first tube, said second tube being substantially the same height as said first tube;

a first flange extending from the top edge of said first tube to the top edge of said second tube across the space between said first and second tubes; and a first attack surface surrounding the inside of said second cylindrical tube opposite said openings in said first cylindrical tube.

2. A filter as claimed in claim 1, wherein said first cylindrical tube, said second cylindrical tube, said bottom and said flange are integrally formed from a sheet material.

3. A filter as claimed in claim 2, wherein:

said sheet material is comprised of a plastic layer and an absorptive paper layer;

said plastic layer being on the inside of said first cylindrical tube and said bottom covering and on the outside of said flange and second cylindrical tube, said paper layer is on the outside of said first cylindrical tube and bottom cover and on the inside of said flange and second cylindrical tube; and said attack surface is integrally formed with said paper layer.

4. A filter as claimed in claim 1, further comprising:

a third cylindrical tube having a plurality of openings around the circumference thereof, said third tube being substantially the same size as and positioned directly beneath said first tube;

a top covering across the top of said third tube and adjacent said bottom covering;

a fourth cylindrical tube surrounding and space from said third tube, beneath, substantially aligned with and contacting said second tube;

a second flange extending from the bottom edge of said third tube to the bottom edge of said fourth tube across the space between said third and fourth tubes; and a second attach surface surrounding the inside of said fourth cylindrical tube opposite said openings in said third cylindrical tube.

* * * * *